US005562115A

United States Patent [19]

Sotelo

[11] Patent Number: 5,562,115

[45] Date of Patent: Oct. 8, 1996

[54] COMBINED TENT-SLEEPING MATT SYSTEM

[76] Inventor: Rudy Sotelo, 110 Ave. C, Ennis, Tex. 75119

[21] Appl. No.: 553,044

[22] Filed: Nov. 3, 1995

[51] Int. Cl.[6] ..... E04H 15/38; E04H 15/00; E04H 15/42; E04H 15/56

[52] U.S. Cl. ..... 135/156; 135/100; 135/116; 135/124; 135/137

[58] Field of Search ..... 5/413, 414, 420; 135/156, 87, 100, 124, 116, 137

[56] References Cited

U.S. PATENT DOCUMENTS

| | | | |
|---|---|---|---|
| 788,791 | 5/1905 | Peralta | 135/156 |
| 3,447,549 | 6/1969 | Cunningham | 135/156 |
| 3,840,919 | 10/1974 | Middleton | 5/413 AM |
| 4,000,585 | 1/1977 | Denaro | 52/2 |
| 4,605,029 | 8/1986 | Russell | 135/106 |

*Primary Examiner*—Alexander Grosz

[57] ABSTRACT

A combined tent-sleeping bag system including a pair of side panels. Each panel has a front edge, a rear edge, a bottom edge, and a common top edge. One of the side panels has a zipper assembly along the bottom edge. The common edge has a plurality of eyelets. Also, included are a plurality of flaps that have a panel edge that is integral the rear edge of the side panels, and a closing edge with a snap-type fastener assembly for coupling with another of the closing edges. Included is a mat that has long side walls, short side walls, a bottom surface, and a cushion-like material. The mat has a plurality of eyelets along the short side wall. The mat forms a first side wall that has a zipper assembly for coupling with the zipper assembly of one of the bottom edges. The mat forms a second side wall that is integral the bottom edge of another of the side panels. Provided is a support pole that is positioned through the eyelets. Included are a pair of long stakes that have a ground piercing end that is positioned through one of the eyelets. Lastly, a plurality of short stakes are positioned in the remaining eyelets of the bottom surface of the mat.

7 Claims, 3 Drawing Sheets

COMBINED TENT-SLEEPING MATT SYSTEM

BACKGROUND OF THE INVENTION

1. Field of the Invention

The present invention relates to a combined tent-sleeping bag system and more particularly pertains to providing a tent-sleeping bag combination that is formed from a singular rectangular structure, and further providing a tent sleeping bag system that may be rolled up into a bundle for storage and carrying.

2. Description of the Prior Art

The use of an outdoor sleeping system is known in the prior art. More specifically, outdoor sleeping systems heretofore devised and utilized for the purpose of sleeping outside on the ground are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,605,029 to Russell discloses a self-supporting outdoor sleeping system. U.S. Pat. No. 3,860,980 to Ebert discloses an accessory for use with a sleeping bag. U.S. Pat. No. Design 327,524 to Kim discloses a combined tent shelter and mat thereof. U.S. Pat. No. 5,033,497 to Hernandez discloses a combination surfboard-shipping bag, ground pad, and tent. U.S. Pat. No. 3,877,092 to Gaiser discloses a self inflatable air mattress and sleeping bag with air pressure control. Lastly, U.S. Pat. No. 3,840,919 to Middleton discloses a combined sleeping bag and inflatable tent.

While these devices fulfill their respective, particular objectives and requirements, the aforementioned patents do not describe combined tent-sleeping bag system that allows a single sheet to be transformed into a tent that has a sleeping bag integral the tent and may be used out of doors by campers.

In this respect, the combined tent-sleeping bag system according to the present invention substantially departs from the conventional concepts and designs of the prior art, and in doing so provides an apparatus primarily developed for the purpose of providing a tent-sleeping bag combination that is formed from a singular rectangular structure and further providing a tent sleeping bag system that may be rolled up into a bundle for storage and carrying.

Therefore, it can be appreciated that there exists a continuing need for a new and improved combined tent-sleeping bag SYSTEM which can be used for providing a tent-sleeping bag combination that is formed from a singular rectangular structure and further providing a tent sleeping bag system that may be rolled up into a bundle for storage and carrying. In this regard, the present invention substantially fulfills this need.

SUMMARY OF THE INVENTION

In view of the foregoing disadvantages inherent in the known types of outdoor sleeping systems now present in the prior art, the present invention provides an improved combined tent-sleeping bag system. As such, the general purpose of the present invention, which will be described subsequently in greater detail, is to provide a new and improved combined tent-sleeping bag system and method which has all the advantages of the prior art and none of the disadvantages.

To attain this, the present invention essentially comprises a pair of side panels that form a first side panel and a second side panel. Each side panel is formed of a waterproof material. Each side panel has a front edge and a rear edge. The front edge and the rear edge of each panel has a length of thirty-six inches. Each panel has an elongated bottom edge with a common elongated top edge. The elongated bottom and the elongated common edge have length of seventy-two inches. The second side panel has a zipper assembly along the bottom edge thereof. The common edge has a plurality of eyelets extending therefrom. Also, included are a plurality of generally angular flaps. The flaps form a pair of front flaps and a pair of rear flaps. Each front flap and each rear flap has a panel edge and a closing edge. The panel edge of each front flap is integral a respective front edge of the first side panel and the second side panel. The panel edge of each rear flap is integral a respective rear edge of the first side panel and the second side panel. Additionally, the closing edge of each front flap has a plurality snap-type fastener assemblies for coupling. Each snap-type fastener assembly of the closing edge of one of the front flaps is capable of coupling with the snap-type fastener assembly of another closing edge of another front flap. The closing edge of each rear flap has a plurality snap-type fastener assemblies for coupling. Each snap-type fastener assembly of the closing edge of one of the rear flaps is capable of coupling with each snap-type fastener assembly of another closing edge of another of the rear flaps. Included is a generally rectangular mat. The mat has a pair of long side walls, a pair of short side walls, a top surface, and a bottom surface, and a cushion-like material therebetween. The mat has a plurality of eyelets that are proportionately spaced along the short side walls and adjacent the bottom surface. The cushion-like material is covered in waterproof material and capable of supporting a person. The long walls of the mat have a length of seventy-two inches. The long walls of the mat form a first side wall and a second side wall. The first side wall is integral the elongated bottom edge of the first side panel. The second side wall has a zipper assembly for coupling with the zipper assembly of the elongated bottom edge of the second side panel to form a tent like structure. Provided is a cylindrical support pole that is positioned through the eyelets of the common edge of the side panels. Included are a pair of long cylindrical stakes. Each stake has a top end and a ground piercing end. Each stake is positioned through one of the eyelets of the common edge of the pair of side panels and one of the eyelets of the bottom surface of the mat. The top end of each stake receives an end of the support pole therein to support the tent like structure when each ground piercing end of the long stake is positioned into the earth. Additionally, a plurality of short cylindrical stakes are positioned in the remaining eyelets of the bottom surface. The short stakes add stability and support to the tent like structure. Lastly, the tent like structure may be folded and rolled to form a rolled bundle that can be carried. The bottom surface of the mat has a front half with a plurality of linear ties attached for securing the rolled bundle. The front half has a plurality of carrying loops for holding the long stakes, the short stakes and the support pole. The front half of the bottom surface has a pair of U-shaped handles attached. The handles are for carrying the rolled bundle with the plurality stakes and the support pole positioned in the carrying loops.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combined tent-sleeping bag system which has all of the advantages of the prior art outdoor sleeping systems and none of the disadvantages.

It is another object of the present invention to provide a new and improved combined tent-sleeping bag system which may be easily and efficiently manufactured and marketed.

It is further object of the present invention to provide a new and improved combined tent-sleeping bag system which is of durable and reliable constructions.

An even further object of the present invention is to provide a new and improved combined tent-sleeping bag system which is susceptible of a low cost of manufacture with regard to both materials and labor, and which accordingly is then susceptible of low prices of sale to the consuming public, thereby making such combined tent-sleeping bag system economically available to the buying public.

Still yet another object of the present invention is to provide a new and improved combined tent-sleeping bag system which provides in the apparatuses and methods of the prior art some of the advantages thereof, while simultaneously overcoming some of the disadvantages normally associated therewith.

Even still another object of the present invention is to provide a combined tent-sleeping bag system for providing a tent-sleeping bag combination that is formed from a singular rectangular structure, and further providing a tent sleeping bag system that may be rolled up into a bundle for storage and carrying.

Lastly, it is an object of the present invention to provide a new and improved combined tent-sleeping bag system including a pair of side panels. Each panel has a front edge, a rear edge, a bottom edge, and a common top edge. One of the side panels has a zipper assembly along the bottom edge. The common edge has a plurality of eyelets extending therefrom. Also, included are a plurality of flaps. Each flap has a panel edge that is integral the rear edge of the side panels and a closing edge with a snap-type fastener assembly for coupling with another of the closing edge of the flaps. Included is a mat that has long side walls, short side walls, a bottom surface, and a cushion-like material therebetween. The mat has a plurality of eyelets that are spaced along the short side wall. The mat forms a first side wall that has a zipper assembly for coupling with the zipper assembly of one of the bottom edges of the side. The mat forms a second side wall that is integral the bottom edge of another of the side panels. Provided is a support pole that is positioned through the eyelets of the common edge. Included are a pair of long stakes where each stake has a top end for receipt of the support pole therein. Each stake has a ground piercing end. Each stake is positioned through one of the eyelets of the common edge and the bottom surface to form a tent like structure. Lastly, a plurality of short stakes are positioned in the remaining eyelets of the bottom surface of the mat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
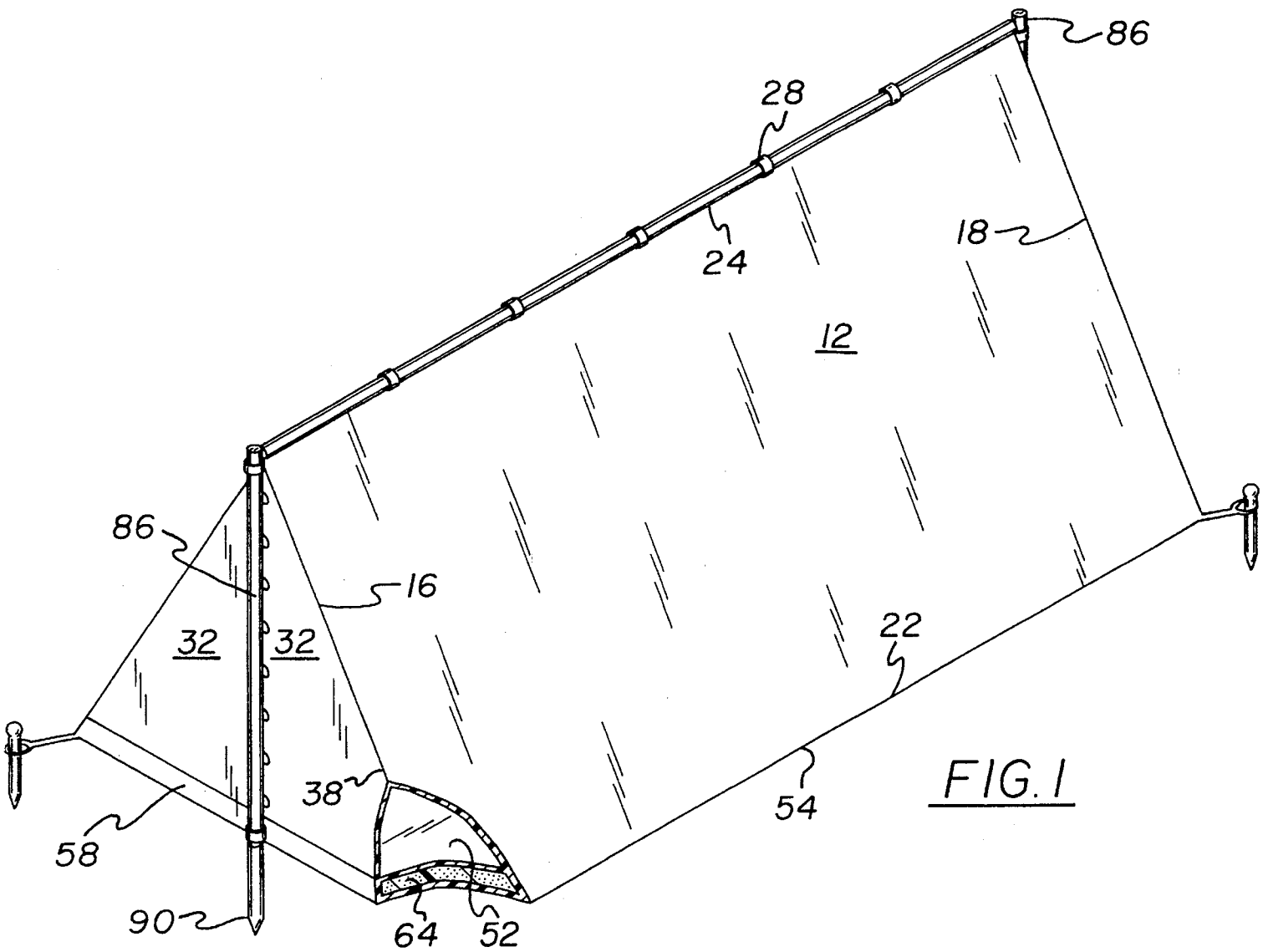
FIG. 1 is a perspective view of the preferred embodiment of the combined tent-sleeping bag system constructed in accordance with the principles of the present invention.

With reference now to the drawings, and in particular to FIG. 1 thereof, the preferred embodiment of the new and improved combined tent-sleeping bag system embodying the principles and concepts of the present invention and generally designated by the reference numeral 10 will be described.

The present invention, the combined tent-sleeping bag system 10 is comprised of a plurality of components. Such components in their broadest context include side panels, flaps, a support pole, long stake, and short stakes. Such components are individually configured and correlated with respect to each other so as to attain the desired objective.

Figure 2:
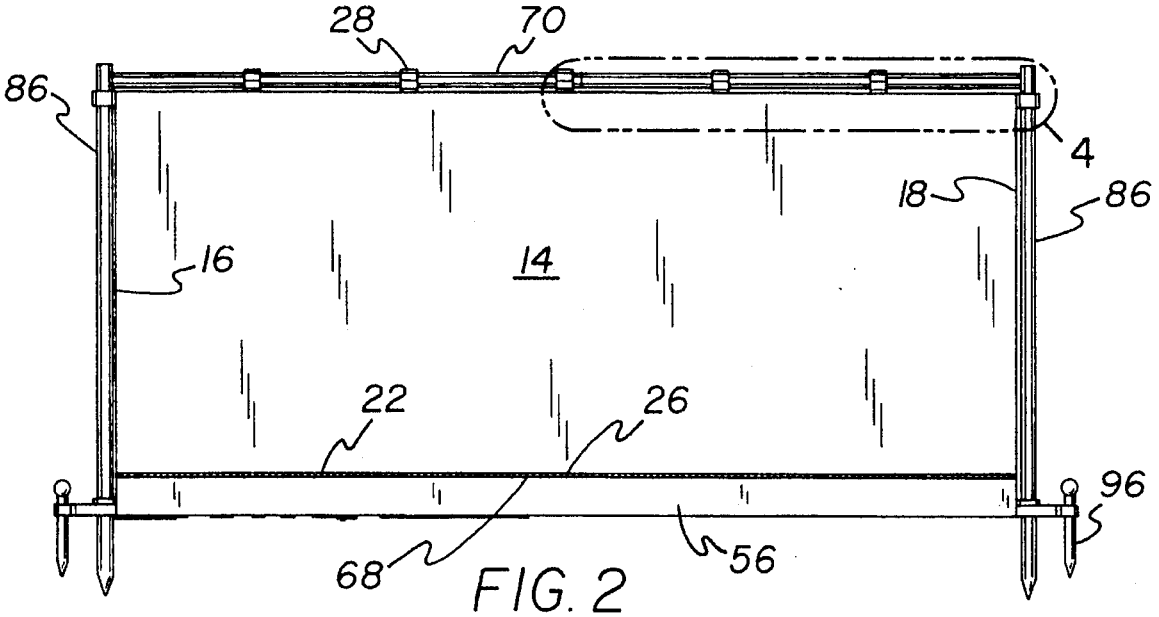
FIG. 2 is a elevated side view of the present invention of FIG. 1.

Specifically, the present invention includes a pair of side panels. The side panels form a first side panel 12 and a second side panel 14. Each side panel is formed of a waterproof material. The material may be vinyl or pretreated canvas. Each side panel has a front edge 16 and a rear edge 18. The front edge and the rear edge of each panel has a length of thirty-six inches. The length of the rear edge and the front edge of each side panel is equivalent to the width of the side panels. Each panel has an elongated bottom edge 22 with a common elongated top edge 24. The elongated bottom and the elongated common edge each have length of seventy-two inches. As illustrated in FIG. 2, the second side panel has a zipper assembly 26 along the bottom edge. The common edge has a plurality of eyelets 28 that extend outward therefrom. The eyelets are shown in FIGS. 1 and 2.

Figure 5:
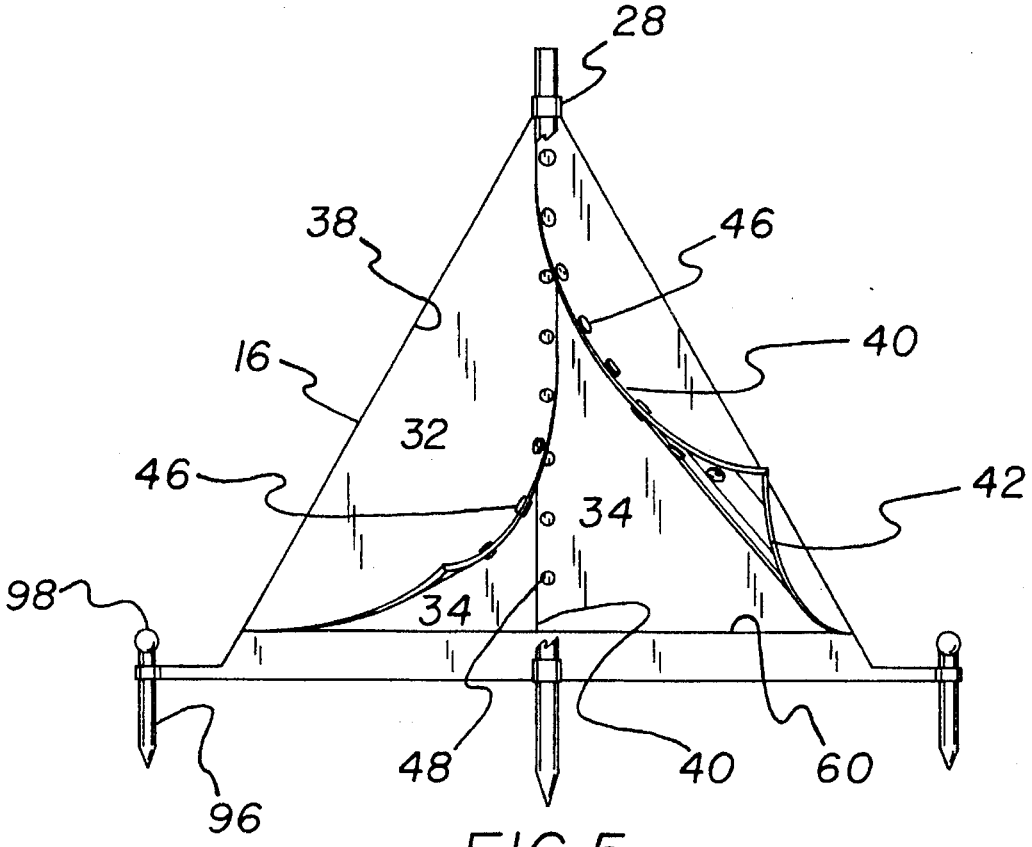
FIG. 5 is a front plan view of the present invention in an operable configuration.

A plurality of generally angular flaps are provided. The flaps form a pair of front flaps 32 and a pair of rear flaps 34. The rear flaps and the front flaps are formed of the material used to make the side panels. Each front flap and each rear flap have a panel edge 38 and a closing edge 40, as shown in FIG. 5. The panel edge of each front flap is integral the respective front edge 16 of the first side panel 12 and the second side panel 14. The panel edge of each rear flap is integral the respective rear edge 18 of the first side panel and the second side panel. The panel edge of each pair of front and rear flaps have a length equal to the length of the front edge and rear edge of the side panels. Each pair of front and rear flaps have a free end 42.

As best illustrated in FIG. 5, the closing edge 40 of each front flap 32 has a plurality of snap-type fastener assemblies 46 thereon for coupling. Each snap-type fastener assembly of the closing edge of one of the front flaps is coupled with the snap-type fastener assembly of another closing edge of anther front flap. The closing edge of each rear flap 34 has a plurality of snap-type fastener assemblies 48 thereon for coupling. Each snap-type fastener assembly of the closing edge of one of the rear flaps is coupled with the snap-type fastener assembly of another closing edge of another of the rear flaps. Each of the snap-type fastener assemblies of the closing of each front and rear flap are proportionately spaced.

Additionally, a generally rectangular mat 52 is included. The mat has a pair of long side walls 54 and 56, a pair of short side walls 58, a top surface 60, and a bottom surface 62 with a cushion-like material 64 therebetween. The cushion-like material is formed of a foam with a thickness of about one-half to three-fourths inch. The mat has a plurality of eyelets 66 that are proportionately spaced along the short side walls and adjacent the bottom surface. The cushion-like material is covered with a waterproof material and capable of supporting a person. The material used to cover the cushion-like material is the same material or fabric used on the panels and flaps. The long walls of the mat have a length of seventy-two inches. The long walls form a first side wall 54 and a second side wall 56. The first side wall is integral with the elongated bottom edge 22 of the first side panel 12. The second side wall has a zipper assembly for coupling with the zipper assembly of the elongated bottom edge of the second side panel 14 to form a tent-like structure.

Figure 4:
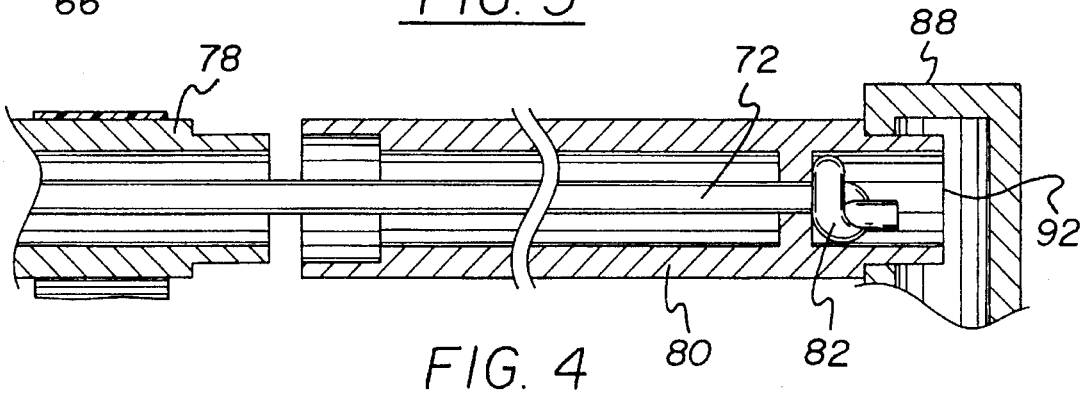
FIG. 4 is a cut-away sectional view of the support pole as shown at position 4 of FIG. 2.

Included is a cylindrical support pole 70. The support pole is positioned through the eyelets 28 of the common edge 24 of the pair of side panels 12 and 14. The pole is formed of a lightweight plastic, preferably polyvinylchorlide. The pole has a length of about seventy-two inches. The pole has an elastized cable 72 within. The pole may be separated and folded to form two sections 78 and 80, with the cables bending when the pole is folded. FIG. 4 shows the two sections of the support pole being separated with the cable therebetween. The cable may be formed of the type of cable that is used in clothes lines. The cable is run through the pole and tied into a knot 82 at each end of the support pole.

A pair of long cylindrical stakes 86 are provided. Each stake has a top end 88 and a ground piercing end 90. Each stake if formed of plastic or a lightweight wood. Each stake has a length of thirty-eight inches. Each stake is positioned through one of the eyelets 28 of the common edge 24 of the pair of side panels 12 and 14 and one of the eyelets 66 of the bottom surface 62 of the mat 52. The top end of each stake receives an end 92 of the support pole 70 for support of the tent-like structure when each ground piercing end of the long stakes are positioned into the earth.

Furthermore, a plurality of short cylindrical stakes 96 are provided. The stakes are positioned in the remaining eyelets 66 of the bottom surface 62 of the mat 52 for additional stability and support of the tent-like structure 10. The short stakes, as shown in FIGS. 2 and 5, have a length of about six inches and a bulb end 98. The bulb end keeps the eyelets from slipping off the short stakes. The short stakes are preferably made of wood, but may be made of plastic.

Figure 3:
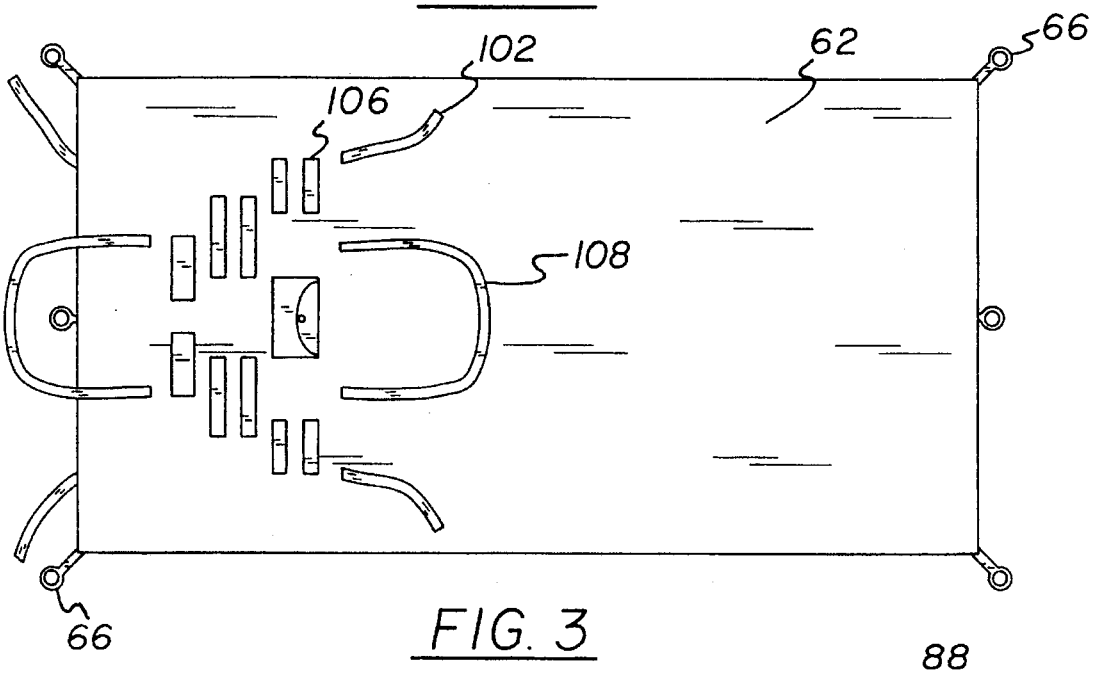
FIG. 3 is a bottom plan view of the present invention.
Figure 6:
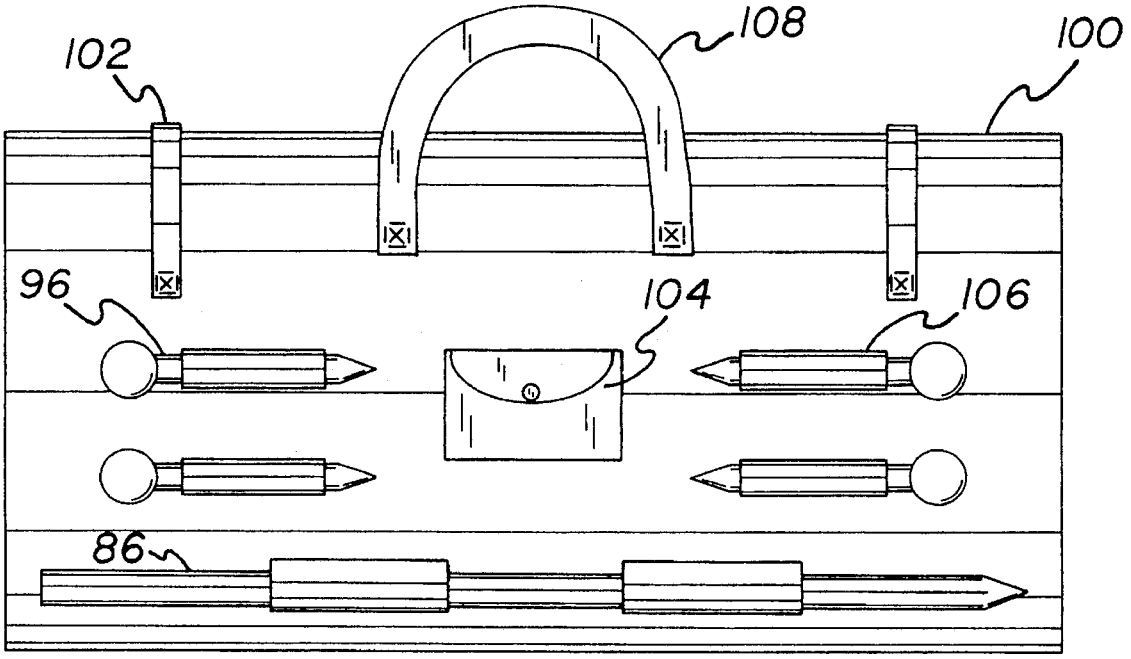
FIG. 6 is the present invention in a rolled bundle for carrying or storage.

Lastly, the tent-like structure 10 may be folded and rolled to form a rolled bundle 100 as shown in FIG. 6, for carrying. The bottom surface of the mat has a front half, as shown in FIG. 3, with a plurality of linear ties 102 attached for securing the rolled bundle. The front half has a pouch 104 that is attached. The front half has a plurality of carrying loops 106 for positioning of the long stakes 86, the short stakes 96 and the support pole 70 therein. The front half of the bottom surface has a pair of U-shaped handles 108 that are attached for carrying of the rolled bundle with a plurality of stakes and the support pole positioned on the bundle. The rolled bundle has a diameter of about forty inches. The ties, the handles, and the carrying loops are made of the same material or fabric that is used to make the tent-like structure. The rolled bundle may be stored with the plurality of stakes and the support pole placed in the carrying loops.

The present invention provides an easy to use and store tent-sleeping bag system for use by campers when sleeping out-of-doors. Generally, the present invention is a rectangular panel that has three parts. There are a pair of side panels, and a mat. The mat remains flat on the ground while the side panels are lifted away from the ground and folded over with a second side panel being zipped to a zipper assembly of the side panel and the mat. The two side panels have a common edge with eyelets positioned along the common edge. A plastic support pole is provided and is placed through the eyelets of the panels. The side panels and the support pole are held above the ground by a pair of long stakes when the support pole is positioned within a top end of a long stake and the long stake is positioned in the ground the tent-like structure is formed. The tent-like structure has a pair of front flaps and a pair of rear flaps that may be closed with the snap-type fastener assembly. Once the person enters the tent-like structure, that person may lay on the mat. Their body will be cushioned by foam which is contained within the interior of the mat. The mat has a back surface that has handles and ties on it and carrying loops. The tent-like structure may be folded into a rectangular shape, once folded, it may be rolled. The rolled tent-like structure creates a rolled bundle that may be secured by ties and carried with carrying handles.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved combined tent-sleeping bag system for camping outside comprising in combination:

a pair of side panels forming a first side panel and a second side panel, each panel being formed of a waterproof material, each panel having a front edge and a rear edge, the front edge and the rear edge of each panel having a length of 36 inches, each panel having a elongated bottom edge with a common elongated top edge, the elongated bottom edge and the elongated common edge having a length of about 72 inches, the second side panel having a zipper assembly along the bottom edge thereof, the common edge having a plurality of eyelets extending therefrom;

a plurality of generally angular flaps forming a pair of front flaps and a pair of rear flaps, each front flap and each rear flap having a panel edge and a closing edge, the panel edge of each front flap being integral the respective front edge of the first side panel and the second side panel, the panel edge of each rear flap being integral the respective rear edge of the first side panel and the second side panel, the closing edge of each front flap having a plurlity of snap-type fastener assemblies thereon for coupling, each snap-type fastener assembly of the closing edge of one of the front flaps being capable of coupling with each snap-type fastener assembly of another closing edge of another front flap, the closing edge of each rear flap having a plurality of snap-type fastener assemblies thereon for coupling, each snap-type fastener assembly of the closing edge of one of the rear flaps being capable of coupling with each snap-type fastener assembly of another closing edge of another of the rear flaps;

a generally rectangular matt having a pair of long side walls, a pair of short side walls, and a top surface and a bottom surface with a cushion-like material therebetween, the matt having a plurality of eyelets proportionately spaced along the short side wall and adjacent the bottom surface, the cushion-like material being covered in waterproof material and capable of supporting a person thereon, the long walls of the matt having a length of about 72 inches, the long walls forming a first side wall and a second side wall, the first side wall being integral the elongated bottom edge of the first side panel, the second side wall having a zipper assembly thereon for coupling with the zipper assembly of the elongated bottom edge of the second side panel to form a tent-like structure;

a cylindrical support pole capable being positioned through the eyelets of the common edge of the pair of side panels;

a pair of long cylindrical stakes with each stake having a top end and a ground piercing end, each stake being capable of being positioned through one of the eyelets of the common edge of the pair of side panels and one of the eyelets of the bottom surface of the matt, the top end of each stake capable of receiving an end of the support pole therein for support of the tent-like structure when each ground piercing end of the long stakes being positioned into the earth;

a plurality of short cylindrical stakes capable of being positioned in the remaining eyelets of the bottom surface of the matt for additional stability and support of the tent-like structure; and the tent-like structure capable of being folded and rolled to form a rolled bundle for carrying, the bottom surface of the matt having a front half with a plurality of linear ties attached thereto for securing the rolled bundle, the front half having a pouch attached thereto, the front half having a plurality of carrying loops for positioning of the long stakes, the short stakes and the support pole therein, the front half of the bottom surface having a pair of U-shaped handles attached thereto for carrying of the rolled bundle with the plurality of stakes and the support pole positioned thereon.

2. A combined tent-sleeping bag system for camping outside comprising in combination:

a pair of side panels with each panel having a front edge, a rear edge, a bottom edge and a common top edge, one of the side panels having a zipper assembly along the bottom edge thereof, the common edge having a plurality of eyelets extending therefrom;

a plurality of flaps with each flap having a panel edge being integral the rear edge of the side panels and a closing edge with a releasable fastener assembly thereon for coupling with another of the closing edge of the flaps;

a matt having long side walls, short side walls, a bottom surface and a cushion-like material therebetween, the matt having a plurality of eyelets spaced along the short side wall and forming a first side wall having a zipper assembly for coupling with the zipper assembly of one of the bottom edge of the side, the matt forming a second side wall integral the bottom edge of another of the side panels;

a support pole being positioned through the eyelets of the common edge;

a pair of vertical long stakes with each stake having a top end for receipt of the support pole therein, and a ground piercing end, each stake being positionable through one of the eyelets of the common edge and one of the eyelets of the short side wall of the matt; and a plurality of short stakes capable of being positioned in the remaining eyelets of the short side wall of the matt the tent-like structure capable of being folded and rolled to form a rolled bundle for carrying with the aid of a pair of handles attached to the bottom surface of the matt.

3. The tent-sleeping bag system as set forth in claim 2 wherein the pair of side panels form a first side panel and a second side panel, the bottom edge and the common edge of each first side panel and second side panel being elongated, the elongated bottom edge and the elongated common edge having a length of about 72 inches, the front edge and the rear edge of each side panel having a length of 36 inches, and each panel being formed of a waterproof material.

4. The tent-sleeping bag system as set forth in claim 3 wherein the plurality of flaps form a pair of front flaps and a pair of rear flaps, and the panel edge of each front flap being integral the front edge of the first side panel and the second side panel, the panel edge of each rear flap being integral the rear edge of the first side panel and the second side panel.

5. The tent-sleeping bag system as set forth in claim 2 wherein the matt having a top surface covering the cushion-like material of the matt, the cushion-like material being a foam and covered in waterproof material, the matt being capable of supporting a person on the cushion-like material, the long walls of the matt having a length of about 72 inches.

6. The tent-sleeping bag system as set forth in claim 2 wherein the support pole has a length of about 72 inches, and the top end the stake being capable of supporting the support pole when the ground piercing end being positioned within the earth.

7. The tent-sleeping bag system as set forth in claim 2 wherein the bottom surface of the matt has a front half with a plurality of linear ties attached thereto for securing the rolled bundle, the front half having a pouch attached thereto, the front half having a plurality carrying loops for positioning of the long stakes the short stakes and the support pole therein, the front half of the bottom surface having a pair of U-shaped handles attached thereto for carrying of the rolled bundle with the plurality of stakes and the support pole positioned thereon.

* * * * *